US009032703B2

(12) United States Patent
Krull et al.

(10) Patent No.: US 9,032,703 B2
(45) Date of Patent: May 19, 2015

(54) SYSTEMS AND METHODS FOR DETECTING COMBUSTOR CASING FLAME HOLDING IN A GAS TURBINE ENGINE

(75) Inventors: Anthony Wayne Krull, Anderson, SC (US); Gilbert Otto Kraemer, Greer, SC (US); Garth Curtis Frederick, Greenville, SC (US); David Kaylor Toronto, Greenville, SC (US)

(73) Assignee: General Electric Company, Schenectady, NY (US)

( * ) Notice: Subject to any disclaimer, the term of this patent is extended or adjusted under 35 U.S.C. 154(b) by 1003 days.

(21) Appl. No.: 13/163,794

(22) Filed: Jun. 20, 2011

(65) Prior Publication Data

US 2012/0317990 A1 Dec. 20, 2012

(51) Int. Cl.

| | |
|---|---|
| ***F02C 9/00*** | (2006.01) |
| ***F02G 3/00*** | (2006.01) |
| ***F23N 5/24*** | (2006.01) |
| ***F23R 3/00*** | (2006.01) |

(52) U.S. Cl.

CPC ..... *F23N 5/245* (2013.01); *F23N 2025/04* (2013.01); *F23N 2041/20* (2013.01); *F23R 3/00* (2013.01)

(58) Field of Classification Search

USPC ..... 60/737–748, 39.091, 39.24, 772, 39.11, 60/779; 702/138; 73/112.01; 431/20, 89, 431/90; 374/144

See application file for complete search history.

(56) References Cited

U.S. PATENT DOCUMENTS

| | | | | |
|---|---|---|---|---|
| 4,744,670 | A * | 5/1988 | Janssen | 374/144 |
| 6,164,055 | A | 12/2000 | Lovett et al. | |
| 6,357,216 | B1 | 3/2002 | Scott et al. | |
| 6,438,961 | B2 | 8/2002 | Tuthill et al. | |
| 6,708,568 | B2 | 3/2004 | Gleeson et al. | |
| 6,848,319 | B2 | 2/2005 | Gleeson et al. | |
| 6,857,320 | B2 | 2/2005 | Gleeson et al. | |
| 6,978,680 | B2 | 12/2005 | Gleeson et al. | |
| 7,017,415 | B2 | 3/2006 | Harrold et al. | |
| 7,111,463 | B2 | 9/2006 | Sprouse et al. | |
| 2006/0046218 | A1 | 3/2006 | Joklik et al. | |
| 2007/0006596 | A1 | 1/2007 | Fujii | |
| 2009/0223228 | A1 * | 9/2009 | Romoser | 60/776 |
| 2010/0170217 | A1 * | 7/2010 | Kraemer et al. | 60/39.091 |

* cited by examiner

*Primary Examiner* — Craig Kim

(74) *Attorney, Agent, or Firm* — Mark E. Henderson; Ernest G. Cusick; Frank A. Landgraff

(57) ABSTRACT

In a gas turbine engine that includes a compressor and a combustor, wherein the combustor includes a primary fuel injector within a fuel nozzle and a secondary fuel injector that is upstream of the fuel nozzle and configured to inject fuel into a flow annulus of the combustor, a method for detecting a flame holding condition about a fuel injector. The method may include the steps of: detecting an upstream pressure upstream of the secondary fuel injector; detecting a downstream pressure downstream of the secondary fuel injector; determining a measured pressure difference between the upstream pressure and the downstream pressure; and comparing the measured pressure difference to an expected pressure difference.

18 Claims, 8 Drawing Sheets

SYSTEMS AND METHODS FOR DETECTING COMBUSTOR CASING FLAME HOLDING IN A GAS TURBINE ENGINE

BACKGROUND OF THE INVENTION

The present disclosure generally relates to systems and methods for detecting flame holding in a gas turbine engine, and more particularly relates to systems and methods for detecting flame holding in the combustor casing of a gas turbine engine.

Many gas turbines include a compressor, a combustor, and a turbine. The compressor creates compressed air, which is supplied to the combustor. The combustor combusts the compressed air with fuel to generate an air-fuel mixture, which is supplied to the turbine. The turbine extracts energy from the air-fuel mixture to drive a load.

In many cases, the gas turbine includes a number of combustors. The combustors may be positioned between the compressor and the turbine. For example, the compressor and the turbine may be aligned along a common axis, and the combustors may be positioned between the compressor and the turbine at an entrance to the turbine, in a circular array about the common axis. In operation, air from the compressor may travel into the turbine through one of the combustors.

The combustors may be operated at a relatively high temperature to ensure the mixture of air and fuel is adequately combusted, improving efficiency. One problem with operating the combustors at a high temperature is that a relatively high level of nitrogen oxides (NOx) may be generated, which may have a negative impact on the environment.

To reduce NOx emissions, many modern gas turbines employ premixing fuel nozzles. For example, each combustor may be supported by a number of fuel nozzles, which may be positioned in a circular array about the combustor. During normal operation, the air from the compressor enters the combustor via the fuel nozzles. Within the fuel nozzles the air is mixed with fuel to form an air-fuel mixture. The air-fuel mixture is then combusted in the combustor. Pre-mixing the air and fuel permits operating the combustors at relatively lower temperatures, which reduces the NOx produced as a by-product of the combustion process.

To achieve further performance advantages, some combustors employ fuel injectors that are positioned upstream of the fuel nozzles. These fuel injectors will collectively be referred to herein as "combustor casing fuel injectors," and, unless stated otherwise, these are defined to include fuel injectors within the combustion system of a gas turbine engine positioned between the compressor and the fuel nozzles. As stated above, many combustion systems pre-mix fuel and air within fuel nozzles. It will be appreciated that the present invention is aimed at the staged pre-mixing that takes place in some combustors upstream of this.

One such system, for example, is generally referred to as an annular quaternary fuel distributor. As described in more detail below, this type of system injects fuel into the compressed air discharged by the compressor as this flow of air moves toward the fuel nozzles. In certain cases, as described in more detail below, the annular quaternary fuel distributor injects fuel into an annulus passageway that is defined by the combustor casing and the cap assembly. It will be appreciated by one of ordinary skill in the art that pre-mixing fuel in this manner may be employed to mitigate combustor instability, to provide better fuel/air mixing, improve flame holding margin of the downstream fuel nozzles, as well as to reduce NOx emissions.

However, combustor casing fuel injectors present their own problems. For example, the combustor casing fuel injectors may catch fire and/or retain flame, which, as referred to herein, creates a situation of combustor casing flame holding. One common reason for flame holding in the combustor casing is flashback, wherein flame travels backward from the combustion zone of the combustor into the fuel nozzle and then from within the fuel nozzle to within the combustor casing. Another common reason for flame holding in the combustor casing is auto-ignition, wherein the fuel within the combustor casing independently catches fire due. This may occur due to irregularities in the fuel composition, the fuel flow, the air flow, or the fuel nozzle surface, among other reasons. Regardless of the cause, the combustor casing may tend to hold or retain the flame, which may damage the combustor, the fuel nozzles that reside downstream, or other portions of the gas turbine.

So that remedial action may be taken to reduce or eliminate flame holding within the combustor casing, techniques have been developed to detect the presence of flame within this area. However, many of these techniques employ sensors, such as temperature sensors, photon emission sensors, or ion sensors, among others. These types of sensors would have to be positioned at several locations within the combustor casing. More specifically, because of the size and configuration of the combustor casing, these types of sensors would have to be placed at a multitude of locations to ensure that flame is detected at the locations at which it might be held. As one of ordinary skill in the art will appreciate, installing and monitoring a plurality of these types of sensors would be expensive.

Accordingly, there is a need for systems and methods that accurately and efficiently detect the presence of a flame holding in the combustor casing of gas turbine engines.

BRIEF DESCRIPTION OF THE INVENTION

The present application thus describes: in a gas turbine engine that includes a compressor and a combustor, wherein the combustor includes a primary fuel injector within a fuel nozzle and a secondary fuel injector upstream of the fuel nozzle, a system for detecting a flame about the secondary fuel injector. The system may include: a first pressure sensor that detects an upstream pressure upstream of the secondary fuel injector; a second pressure sensor that detects a downstream pressure downstream of the secondary fuel injector; means for determining a measured pressure difference between the upstream pressure and the downstream pressure; and means for comparing the measured pressure difference to an expected pressure difference.

The present application further describes: in a gas turbine engine that includes a compressor and a combustor, wherein the combustor includes a primary fuel injector within a fuel nozzle and a secondary fuel injector that is upstream of the fuel nozzle and configured to inject fuel into a flow annulus of the combustor, a method for detecting a flame holding condition about a fuel injector. The method may include the steps of: detecting an upstream pressure upstream of the secondary fuel injector; detecting a downstream pressure downstream of the secondary fuel injector; determining a measured pressure difference between the upstream pressure and the downstream pressure; and comparing the measured pressure difference to an expected pressure difference.

These and other features of the present application will become apparent upon review of the following detailed description of the preferred embodiments when taken in conjunction with the drawings and the appended claims.

BRIEF DESCRIPTION OF THE DRAWINGS

The present disclosure may be better understood with reference to the following figures. Matching reference numerals designate corresponding parts throughout the figures, and components in the figures are not necessarily to scale.

DETAILED DESCRIPTION OF THE INVENTION

Figure 1:
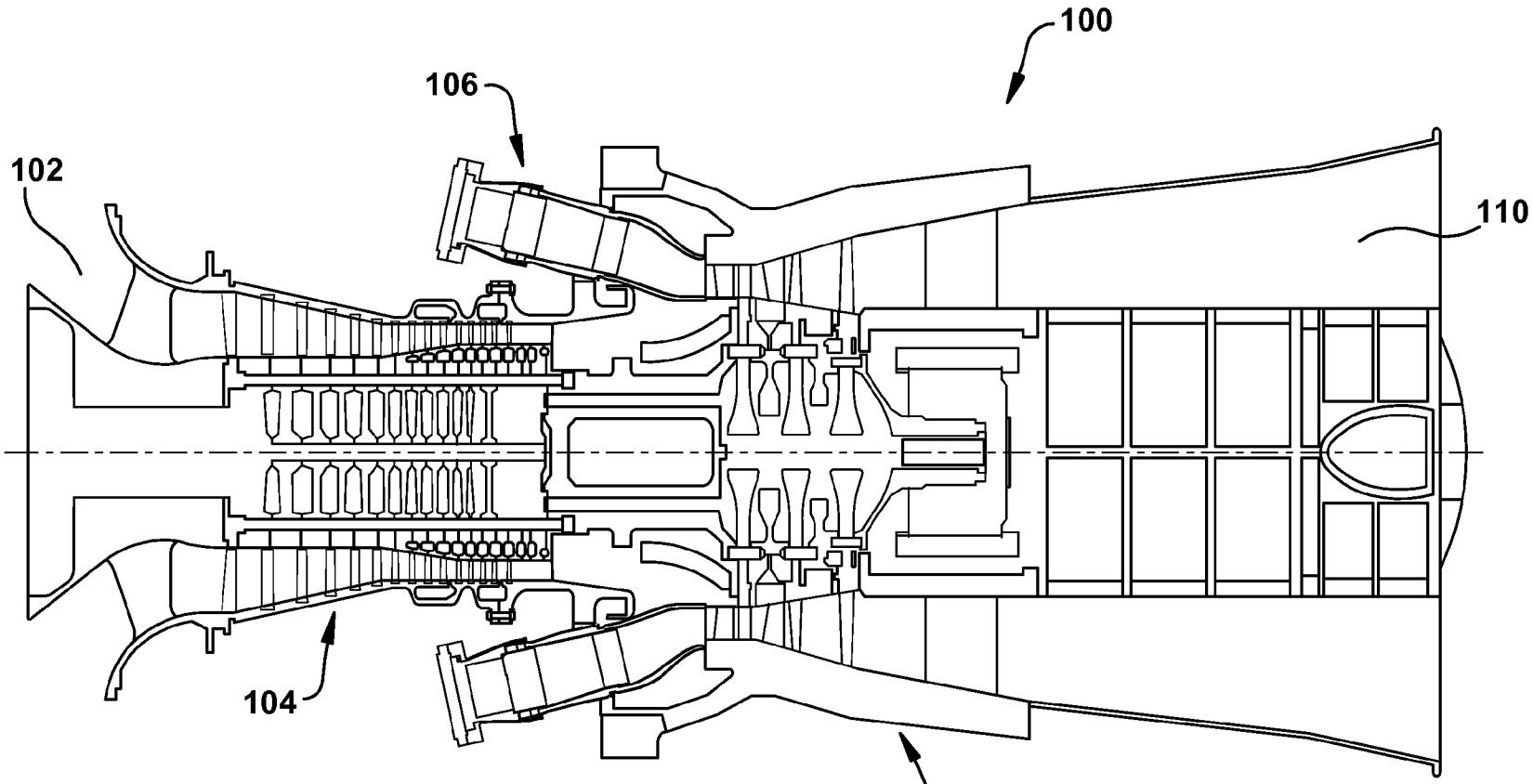
Figure 1 (Prior Art)
FIG. 1 is a cross-sectional view of a known gas turbine engine, schematically illustrating a combustion system in which a system for detecting flame holding in the combustor casing of the gas turbine engine may be employed.

Described below are systems and methods for detecting a flame in a combustor casing which is caused by a combustor casing fuel injector of a gas turbine engine. The systems and methods may detect the flame holding in the combustor casing by detecting an increase in a pressure drop across locations within the combustor, as described below. For example, the systems and methods may detect combustor casing flame holding by detecting an increase in a pressure drop across a distance within the combustor casing from a location upstream of the combustor casing fuel injector to a location downstream of the combustor casing fuel injector. The increased pressure drop may result due to the flame, which may increase the temperature and/or decrease the density of air flowing through the affected area. It will be appreciated that, due to the increased volume of the air, the pressure downstream of the combustor casing fuel injector may increase, which may increase the pressure drop across the specified distance. Pressure loss tends to increase as the square of the increase in volumetric flow rate.

The pressure drop may be detected by determining a difference between an upstream pressure that is measured upstream of the combustor casing fuel injector and a downstream pressure that is measured downstream of the combustor casing fuel injector. If the pressure difference exceeds an expected pressure difference, a flame may be present in one or more fuel nozzles of the array. Thus, to detect a flame within the combustor casing, it may not be necessary to associate a plurality of sensors to cover the entire area, as the detection may occur by detecting a pressure drop using few sensors. It will be appreciated that such a configuration may reduce the cost associated with flame detection within the combustor casing.

In embodiments, the upstream pressure and the downstream pressure may be detected in close proximity to the position of the combustor casing fuel injector. For example, the upstream pressure may be detected in the air flow path into the combustor, whereas and the downstream pressure may be detected just downstream of the combustor casing fuel injector. As described in more detail below, other locations are possible.

In addition, certain embodiments of the present invention may employ an integrated probe that is designed to detect a pressure difference. In certain embodiments, the integrated probe may extend through a flow sleeve of the combustor into the combustion chamber. The integrated probe may be positioned to sense both the upstream pressure and downstream pressure simultaneously. In some such embodiments, the integrated probe may serve other functions. For example, the integrated probe may include a combustion dynamics monitoring (CDM) probe suited for monitoring dynamic pressure in the combustor. In such cases, it may be relatively easy and inexpensive to retrofit a gas turbine with the system for detecting flame in the fuel nozzles, such as by removing the CDM probe from the gas turbine and installing the integrated probe in its place.

Figure 2:
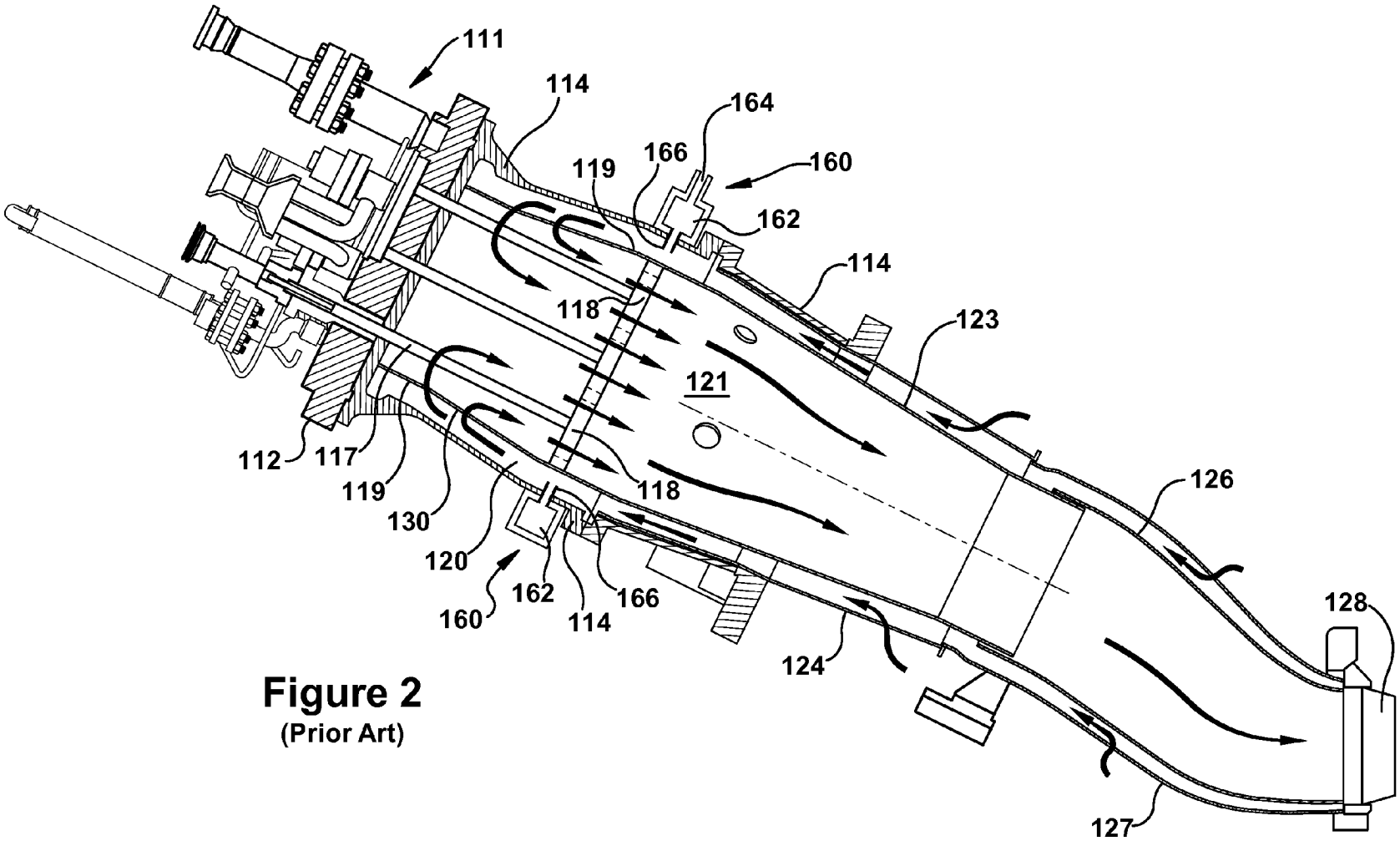
Figure 2 (Prior Art)
FIG. 2 is a cross-sectional view of a known combustor, schematically illustrating a combustor in which a system for detecting flame holding in the combustor casing of the gas turbine engine may be employed.

FIG. 1 is a partial cross-sectional view of a known gas turbine engine 100 in which embodiments for detecting flame holding occurring within the combustor casing. As shown, the gas turbine engine 100 generally includes an intake section 102, a compressor 104, one or more combustors 106, a turbine 108, and an exhaust section 110. Each combustor 106 may include one or more fuel nozzles 118, as shown in FIG. 2. The fuel nozzles 118 may be in parallel to each other in an array. For example, the fuel nozzles 118 may be arranged about an entrance to the combustor 106, such as in a circular configuration about a longitudinal axis of the combustor 106.

A flow path may be defined through the gas turbine 100. During normal operation, air may enter the gas turbine 100 through the intake section 102. The air may flow into the compressor 104, which may compress the air to form compressed air. The compressed air may flow through the fuel nozzles 118, which may mix the compressed air with fuel to form an air-fuel mixture. The air-fuel mixture may flow into the combustor 106, which may burn the air-fuel mixture to generate hot gases. The hot gases may flow into the turbine 108, which may extract energy from the hot gases, forming exhaust. Thereafter, the exhaust may be exhausted from the gas turbine 100 through the exhaust section 110.

FIG. 2 illustrates an exemplary combustor 106 in a gas turbine engine in which embodiments of the present invention may be used. As one of ordinary skill in the art will appreciate, the combustor 106 may include a headend 111, which generally includes the various manifolds that supply the necessary air and fuel to the combustor 106, and an end cover 112. The combustor 106 may be enclosed within a combustor casing 114, as shown. A plurality of fuel lines 117 may extend through the end cover 112 to fuel injectors or fuel nozzles 118 that are positioned at the aft end of a cap assembly 119. The fuel nozzles 118, which may also be referred to as primary fuel injectors, represent the main source of fuel within the combustor 106. It will be appreciated that the cap assembly 119 generally is cylindrical in shape and fixed at a forward end to the end cover 112. The cap assembly 119 may be surrounded by the combustor casing 114. It will be appreciated by those of ordinary skill in the art that between the combustor casing 114 and the cap assembly 119, a combustor casing annulus 120 is formed.

In general, the fuel nozzles 118 bring together a mixture of fuel and air for combustion. The fuel, for example, may be natural gas and the air may be compressed air (the flow of which is indicated in FIG. 2 by the several arrows) supplied from the compressor 104. As one of ordinary skill in the art will appreciate, downstream of the fuel nozzles 118 is a combustion chamber 121 in which the combustion occurs. The combustion chamber 121 is generally defined by a liner 123, which is enclosed within a flow sleeve 124. Between the flow sleeve 124 and the liner 123 an annulus is formed. From the liner 123, a transition duct 126 transitions the flow from the circular cross section of the liner 123 to an annular cross section as it travels downstream to the turbine section (not shown in FIG. 4). An impingement sleeve or outer wall 127 (hereinafter "outer wall 127") may enclose the transition duct 126, also creating an annulus between the outer wall 127 and the transition duct 126. At the downstream end of the transition duct 126, a transition piece aft frame 128 may direct the flow of the working fluid toward the airfoils that are positioned in the first stage of the turbine 110. It will be appreciated that the flow sleeve 124 and the outer wall 127 typically have impingement apertures (not shown in FIG. 2) formed therethrough which allow an impinged flow of compressed air from the compressor 106 to enter the cavities formed between the flow sleeve 124 and the liner 123 and between the outer wall 127 and the transition duct 126. The flow of compressed air through the impingement apertures convectively cools the exterior surfaces of the liner 123 and the transition duct 126. It will be appreciated that the transition duct 126/outer wall 127, the liner 123/flow sleeve 124, and the cap assembly 119/combustor casing 114 form a flow annulus that extends almost the entire length of the combustor. As used herein, the term "flow annulus" may be used generally to refer to this entire annulus or a portion thereof.

As shown, the cap assembly 119 may include a series of inlets 130 through which the supply of compressed air enters the interior of the cap assembly 119. The inlets 130 may be arranged parallel to each other, being spaced around the circumference of the cylindrical cap assembly 119, though other configurations are possible. In this arrangement, it will be appreciated that struts are defined between each of the inlets 130, which support the cap assembly structure during operation. It will be appreciated that the compressed air entering the combustor 106 through the flow sleeve 124 and the outer wall 127 is directed toward the cap assembly 119, then passes through the combustor casing annulus 120, which, as stated is the annulus formed between the cap assembly 119 and the combustor casing 114, and then enters the cap assembly 119 via the inlets 130, which are typically formed toward the forward end of the cap assembly 119. Upon entering the cap assembly 119, the flow of compressed air is forced to make an approximate 180° turn such that it moves toward the fuel nozzles 118.

It will be appreciated that the combustor of FIG. 2 further includes a fuel injector upstream of the fuel nozzles 118, which will be referred to herein as a secondary fuel injector or a combustor casing fuel injector 160. As stated, and unless otherwise stated, a combustor casing fuel injector 160 includes any fuel injector within the combustion system of a gas turbine engine 100 that injects fuel into the flow path at a position that is downstream of the compressor 104 and upstream of the fuel nozzles 118. In certain embodiments, however, a combustor casing fuel injector 160 may be defined more specifically. As described below, in these instances, a combustor casing fuel injector 160 is defined as a fuel injector that is positioned to inject fuel into the combustor casing annulus 120. FIG. 2 provides an example of this type of combustor casing fuel injector 160.

More specifically, FIG. 2 depicts an annular quaternary fuel distributor, which, as one of ordinary skill in the art will appreciate, is a known type of combustor casing fuel injector 160. As described in more detail below, this type of fuel injection system injects fuel into the compressor discharge as it moves through the combustor casing annulus 120. Premixing fuel in this manner may be employed to mitigate combustor instability, to provide better fuel/air mixing, improve flame holding margin of the downstream fuel nozzles, as well as to reduce NOx emissions.

As illustrated in FIG. 2, the exemplary annular quaternary fuel distributor 160 includes an annular fuel manifold 162 that may encircle (either in segments or continuously) the combustor 106. The annular fuel manifold 162 may abut and attached to the combustor casing 114. The fuel manifold 162 may include one or more inlets 164 through which a supply of fuel is delivered to the manifold 162. The combustor casing fuel injector 160 also may include a plurality of fuel injectors 166 spaced at intervals around the combustor 106. The fuel injectors 166 may deliver the fuel from the manifold 162 to outlets within the combustor casing annulus 120. The fuel injectors 166 may be installed through the combustor casing 114. The fuel injectors 166 may include a peg design, an annular manifold design, or other known design. It will be appreciated that the main function of the combustor casing fuel injector 160 is to inject fuel into the flow of air upstream of the fuel nozzles 118 so that a desirable fuel-air mixture is created. In certain embodiments, the combustor casing fuel injector 160 may inject the fuel into the flow annulus at a position that is upstream of where the flow enters the interior of the cap assembly 119 (i.e., upstream of the inlets 130). Those of ordinary skill in the art will appreciate that the use of the combustor casing fuel injector 160 of FIG. 2 is exemplary only. Embodiments of the present invention are applicable to any other combustor casing fuel injector 160.

Known combustor casing fuel injectors, particularly quaternary fuel injectors having a peg design, are susceptible to instances of flame-holding, which, as stated, refers to the phenomena of unexpected flame occurrence immediately downstream of the fuel injectors 166. Flame-holding can lead to severe damage to combustor hardware. However, known systems and methods for detecting this type of flame holding are expensive and, often, yield detection results that are inaccurate.

Figure 3:
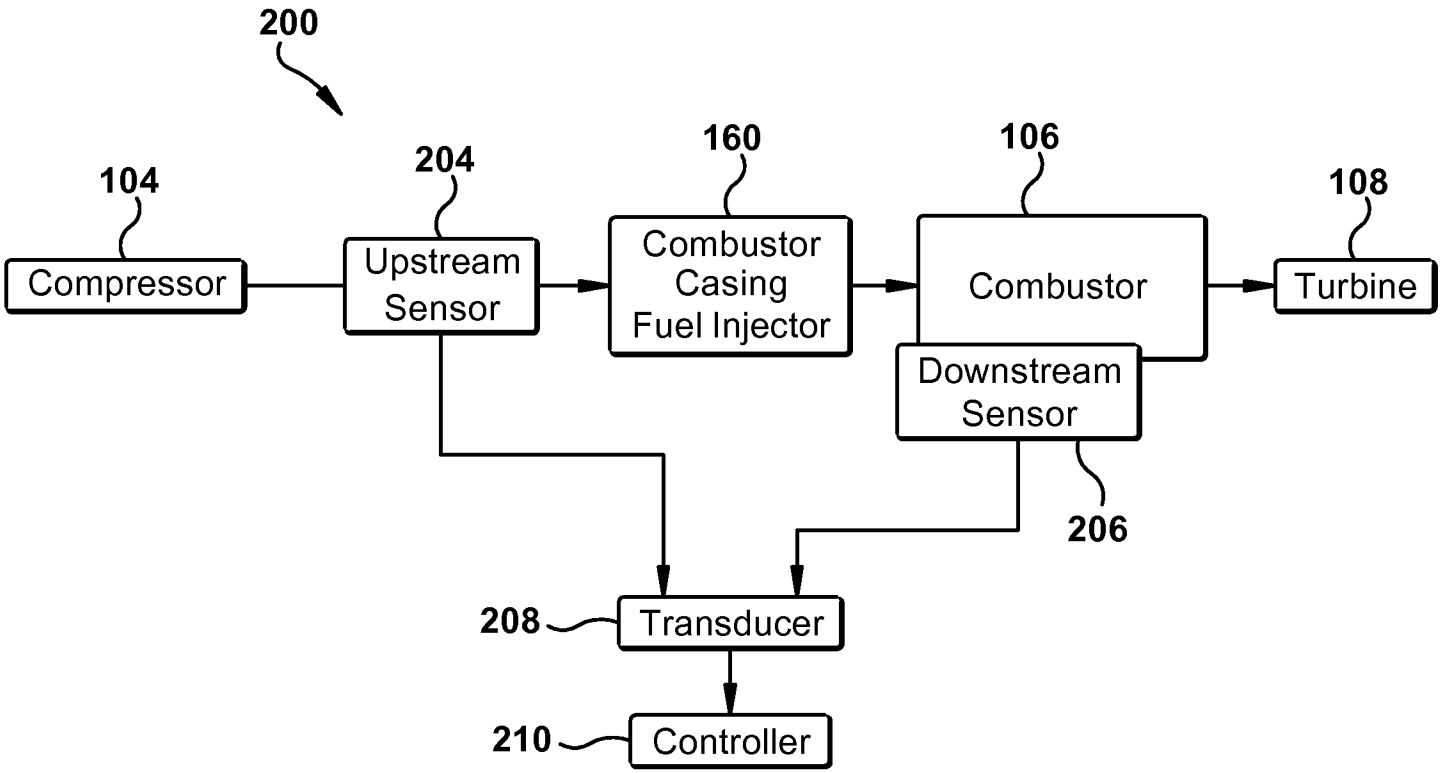
FIG. 3 is a block diagram illustrating an embodiment of a system for detecting a flame in the combustor casing of a gas turbine engine.

FIG. 3 is a block diagram illustrating an embodiment of a system for detecting a flame in the combustor casing of a gas turbine engine. Hereinafter, the fuel injector will be described as a combustor casing fuel injector 160. It will be appreciated that this type of fuel injector may be an annular quaternary fuel distributor, similar to the one described above, or other type of fuel injector located in the described location. During normal operation, a pressure upstream of the combustor casing fuel injector 160 may exceed a pressure downstream of the combustor casing fuel injector 160. For the purposes of this disclosure, the term "upstream pressure" is defined to be a static pressure of compressed air at a point between the compressor exit and the combustor casing fuel injector 160. The upstream pressure may also be referred to herein as the compressor discharge pressure (PCD). A person of skill would appreciate that the upstream pressure may vary along the flow path between the compressor exit and the combustor casing fuel injector 160, and that each of these pressures constitutes a compressor discharge pressure (PCD). A person of skill would also appreciate that the compressor discharge pressure (PCD) may not be assessed at the compressor discharge exactly. For the purposes of this disclosure, the term "downstream pressure" is defined to be the static pressure downstream of the combustor casing fuel injector 160. In certain embodiments, the downstream pressure also may be referred to as a combustor chamber pressure (PCC), as the downstream pressure may be taken from within the combustor chamber. It will be appreciated that the downstream pressure also may be the pressure within the combustor casing annulus 120 downstream of the combustor casing fuel injector 160. In certain embodiments, the downstream pressure may be the pressure within the interior of the cap assembly 119 and upstream of the fuel nozzles 118.

As mentioned, the upstream pressure may exceed the downstream pressure under normal operating conditions. Such an expected pressure difference between the upstream and downstream pressures (PCD-PCC) may assist with driving flow along the flow path. The expected pressure difference may be within a known range, which may vary depending on, for example, the configuration of the gas turbine 100 or the current operating conditions.

In some situations, a flame may be present within the combustor casing 114. In some instances, this flame may be within the combustor casing annulus 120. It will be appreciated that the flame may be held there by the fuel being injected by the combustor casing fuel injector 160. As stated, the flame may be due to, for example, flashback or auto-ignition. Flashback denotes the propagation of flame from the combustion reaction zone of the combustor 106 into the combustor casing 114, while auto-ignition denotes spontaneous ignition of the air-fuel mixture within the combustor casing 114. However, a flame may be present in a combustor casing 114 for any other reason.

Thus, the gas turbine 100 may include a system 200 for detecting a flame in a combustor casing 114 of the gas turbine 100. The system 200 may detect a flame in any area of the combustor casing 114 by detecting an increase in the pressure difference across the combustor casing fuel injector 160.

It will be appreciated that, when a flame is present in the combustor casing 114, the compressed air traveling through the combustor casing may become hotter and may expand, which may increase the air flow resistance through the combustor casing 114. Thus, the air may be relatively less able to flow through the combustor casing 114. To compensate for the decreased air flow through the combustor casing 114, the compressed air may be re-directed through other areas of the combustor casing 114 where the flame may not be present. Thus, a relatively larger volume of air may be forced to travel through relatively less space or at higher velocities, which may increase the pressure upstream of the combustor casing fuel injector 160.

Due to the increased upstream pressure and/or the decreased downstream pressure, when the combustor casing 114 holds flame, a pressure difference across the combustor casing fuel injector 160. More specifically, a pressure drop across the combustor casing fuel injector 160 may exceed an expected pressure drop. Stated alternatively, the difference between the compressor discharge pressure (PCD) and the combustor chamber pressure (PCC) may be relatively larger when a flame is present in combustor casing 114 (i.e., when flame holding about the combustor casing fuel injector 160 is occurring) than during normal operation of the gas turbine 100. Such a change in pressure difference may be detected by the system 200 to determine that the combustor casing 114 is holding flame. With this knowledge, remedial action may be taken to protect the gas turbine 100 from further damage. For example, the flame may be reduced or extinguished in any manner now known or later developed.

Referring again to FIG. 3, a block diagram is provided that illustrates an embodiment of the system 200 for detecting a flame in the combustor casing 114. As shown, the system 200 may include an upstream pressure sensor 204, a downstream pressure sensor 206, and a transducer 208. The upstream pressure sensor 204 may be positioned between the compressor 104 and the combustor casing fuel injector 160. The upstream pressure sensor 204 may detect the compressor discharge pressure (PCD), as described. The downstream pressure sensor 206 may be positioned downstream of the combustor casing fuel injector 160. The downstream pressure sensor 206 may detect the pressure at several different downstream locations, as provided in more detail below. The pressure sensors 204, 206 may be operatively associated with a transducer 208, such as a differential pressure transducer. The transducer 208 may detect a pressure difference between the upstream pressure and the downstream pressure. The pressure sensors 204, 206 may be connected to the transducer 208 in any possible manner. For examples, the pressure sensors 204, 206 may be separate physical components operatively connected to the transducer 208, or the pressure sensors 204, 206 may be figurative functions of the transducer 208. In other words, the transducer 208 may detect a pressure difference between the upstream and downstream pressures, instead of taking an independent measurement of the upstream pressure, taking an independent measurement of the downstream pressure, and subtracting the two measurements to determine the pressure difference.

In some embodiments, the pressure sensors 204, 206 may be operatively associated with a number of pressure transducers 208, which may enable redundant detection and may reduce the likelihood of false indications of flame. Also, in some embodiments, a number of pressure sensors 204, 206 may be operatively associated with the one or a number of pressure transducers 208, for the same reasons. In such cases, a typical voting procedure may be employed to determine if a false indication of flame has occurred.

In embodiments, the system 200 may further include a controller 210. The controller 210 may be implemented using hardware, software, or a combination thereof for performing the functions described herein. By way of example, the controller 210 may be a processor, an ASIC, a comparator, a differential module, or other hardware means. Likewise, the controller 210 may comprise software or other computer-executable instructions that may be stored in a memory and executable by a processor or other processing means.

The controller 210 may receive the detected pressure difference from the transducer 208, such as by way of a signal. The controller 210 may also be aware of an expected pressure difference. For example, the controller 210 may store the expected pressure difference, such as in a memory of the controller 210. The controller 210 may also determine the expected pressure difference, such as by applying an algorithm to known parameters of the gas turbine 100 or measured operating conditions of the gas turbine 100, among others. The controller 210 may compare the detected pressure difference to the expected pressure difference, and in the event that the detected pressure difference exceeds the expected pressure difference, the controller 210 may indicate that the flame condition exists within the combustor casing 114 of the gas turbine 100. In some embodiments, the expected pressure difference may include a range of acceptable pressure differences, in which case the controller 210 may compare the detected pressure difference to the range of expected pressure difference to determine whether the detected pressure difference falls within the range. If the detected pressure difference is not within the range, the controller 210 may indicate the presence of the flame in the fuel nozzle 118.

Figure 4:
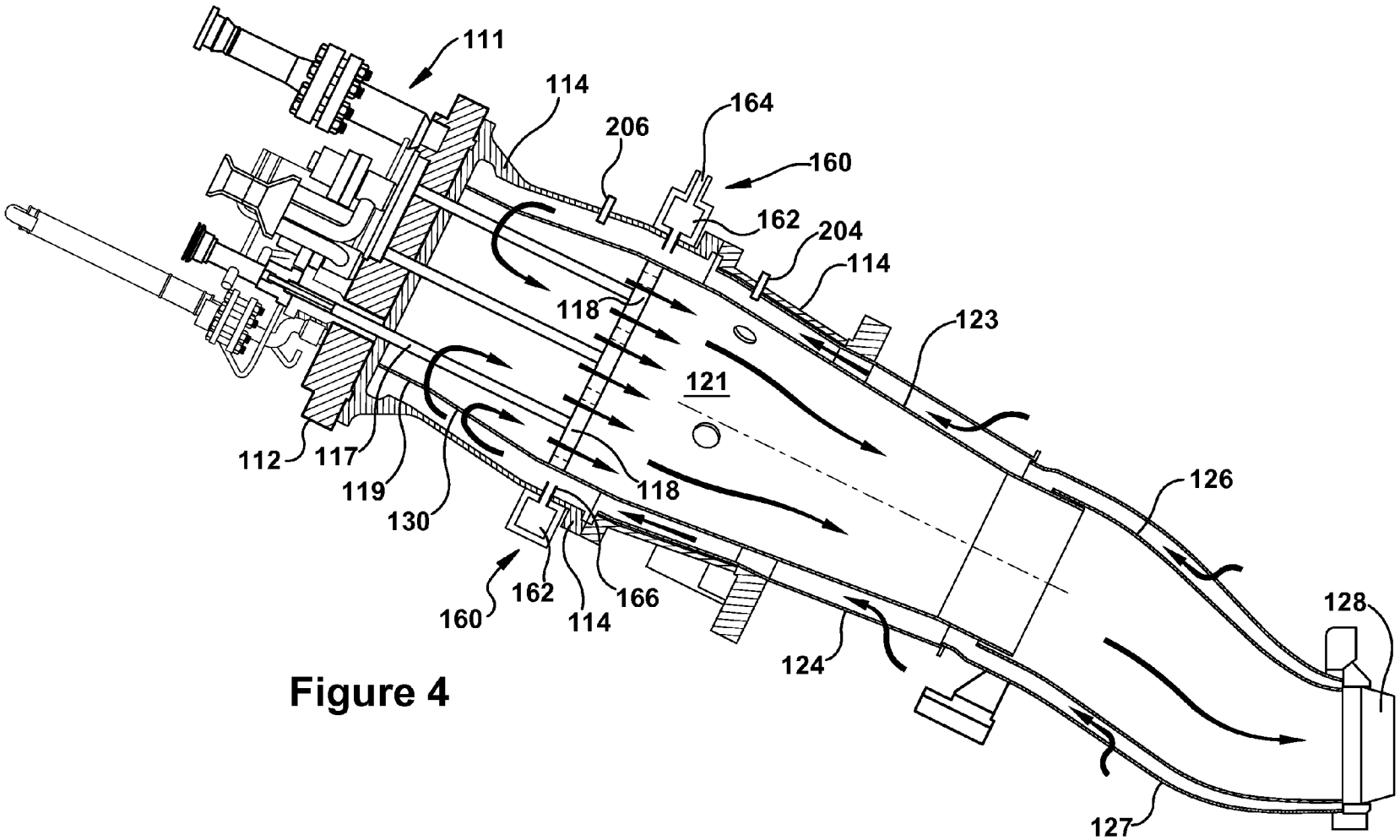
FIG. 4 is a partial cross-sectional view of a combustor of a gas turbine, illustrating an exemplary flame holding detection embodiment in accordance with the present invention.

FIG. 4 is a cross-sectional view of a combustor of a gas turbine in which an exemplary flame holding detection system in accordance with the present invention is illustrated. As shown, the upstream and downstream pressure sensors 204, 206 may be positioned in close proximity to the combustor casing fuel injector 160. An exterior of the combustor 106 may be defined by a combustor casing 114. The combustor casing 114 may be suited for securing the combustor 106 to the turbine 108. The combustor casing 114 may be substantially cylindrical in shape such that the combustor casing annulus 120 is formed between it and the cap assembly 119. As stated, a liner 123 may be positioned on an interior of the combustor casing 114. The liner 123 may also be substantially cylindrical in shape and may be concentrically disposed with reference to the combustor casing 114. The combustion liner 123 may define the periphery of a combustor chamber 121, which may be suited for burning the air-fuel mixture as mentioned above. The combustion chamber 121 may be bounded on an inlet end by the cap assembly 119 and on an outlet end by a transition duct 126. The transition duct 126 may connect with an inlet to the turbine 108, so that hot gas produced upon combustion of the air-fuel mixture can be directed into the turbine 108.

To provide the air-fuel mixture to the combustion chamber 121, a number of fuel nozzles 118 may be in fluid communication with the interior of the combustion chamber 121. The fuel nozzles 118 may be positioned in parallel to each other at the input end of the combustor 106. More specifically, the fuel nozzles 118 may extend through the cap assembly 119. The fuel nozzles 118 may receive air from the compressor 104, may mix the air with fuel to form the air-fuel mixture, and may direct the air-fuel mixture into the combustion chamber 121 for combustion.

So that air from the compressor 104 can reach the fuel nozzles 118, a flow sleeve 124 may be positioned about the combustor 106. As shown, the flow sleeve 124 may be substantially cylindrical in shape and may be concentrically positioned between the combustor casing 114 and the combustor liner 123. More specifically, the flow sleeve 124 may extend between a radial flange of the combustor casing 114 and an outer wall 127 of the transition duct 126. An array of apertures may be formed through the flow sleeve 124 near the transition duct 126. The apertures may permit air from the compressor 104 to flow, in a reverse direction, from the compressor 104 toward the fuel nozzles 118. More specifically, the air may flow along an air flow path 140 defined in an annular space between the flow sleeve 124 and the combustor liner 123, as indicated by the arrows.

As mentioned above, the upstream and downstream pressure sensors 204, 206 may be positioned in close proximity to the combustor casing fuel injector 160. In some cases, this may reduce the likelihood of inaccuracies in the pressure readings. For example, the upstream pressure sensor 204 may be positioned in the air flow path 140 between the flow sleeve 124 and the combustion liner 123, which permits detecting the compressor discharge pressure (PCD) in close proximity to the combustor casing fuel injector 160, as indicated in FIG. 4. Similarly, the downstream pressure sensor 206 may be positioned just downstream of the combustor casing fuel injector 160. As shown in FIG. 4, the downstream sensor 206 may be positioned just downstream of the combustor casing fuel injector 160 in the combustor casing annulus 120. By positioning the sensors 204, 206 in close proximity to the combustor casing fuel injector 160, the sensors 204, 206 may be relatively less likely to detect pressure aberrations attributable to causes other than flame holding occurring in the combustor casing 114.

It has been discovered through experimentation and computer modeling that, for many modern gas turbines engines, specific threshold pressure differences (i.e., pressure differences between the expected drop in pressure and the measured drop in pressure between the upstream and downstream sensors) prove particularly accurate at predicting flame holding conditions about the combustor casing fuel injector. It will be appreciated that one manner in which this threshold may be expressed is the following equation:

$$dP\,\%_{(meas)} - dP\,\%_{(exp)} \geq T$$

where $dP\,\%_{(meas)}$ is the measured percent decrease in pressure from the upstream sensor 204 to the downstream sensor 206, where $dP\,\%_{(exp)}$ is the expected percent decrease in pressure from the upstream sensor 204 to the downstream sensor 206, and where T is the threshold at which the difference between these two values is sufficiently large that a flame holding condition is sufficiently likely that remedial action is warranted. In addition, it has been determined that threshold T may depend upon the flowpath position at which the downstream sensor 206 is located. Accordingly, when the downstream sensor 206 is positioned similar to that illustrated in FIG. 4 (i.e., within the combustor casing annulus 120), it has been found that, in preferred embodiments, threshold T comprises a value of approximately 0.1%. More preferably, threshold T comprises a value of approximately 0.2%. However, it will be appreciated that the value of T may vary for different combustion modes and combustion systems.

Figure 5:
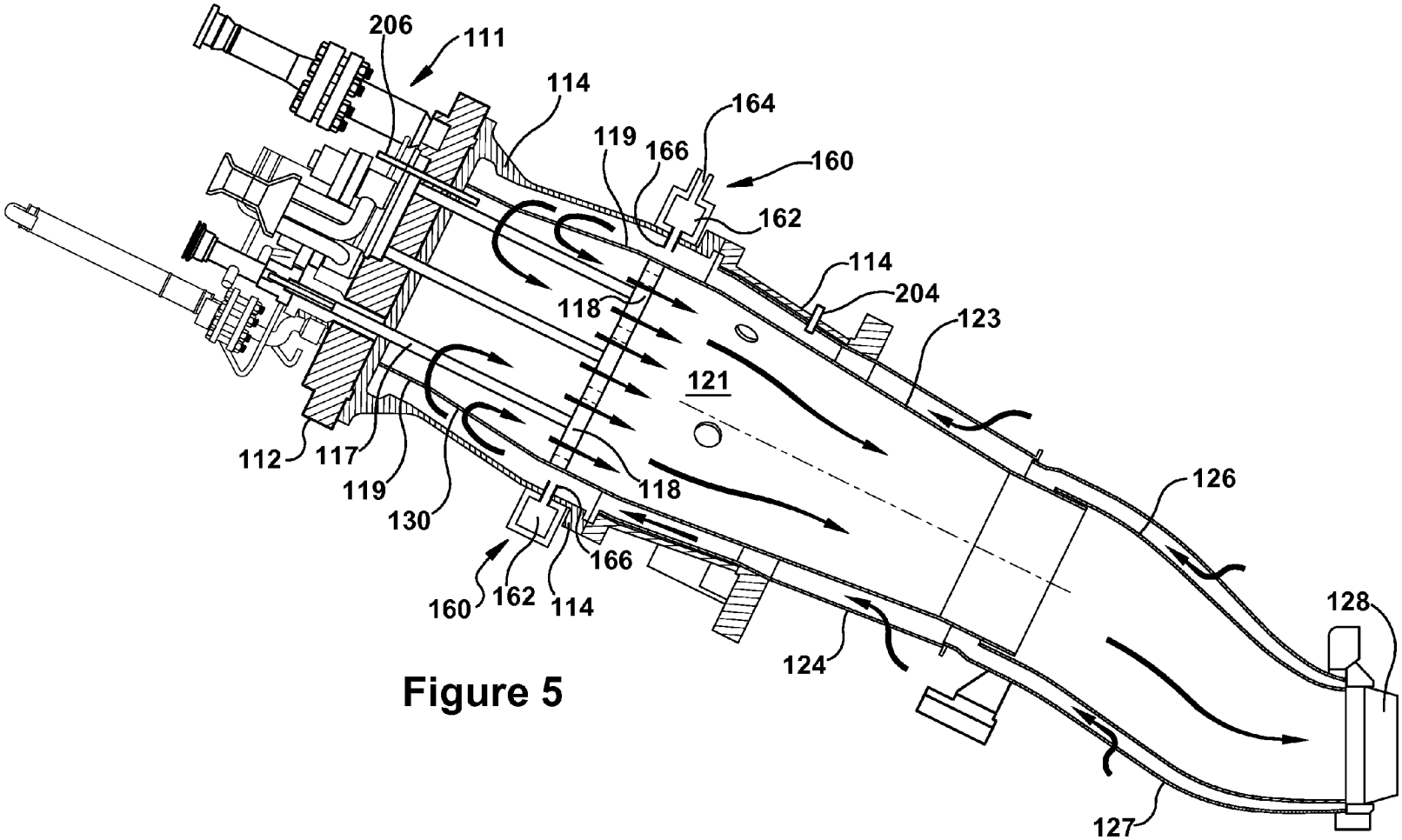
FIG. 5 is a partial cross-sectional view of a combustor of a gas turbine, illustrating an exemplary flame holding detection embodiment in accordance with the present invention.

FIG. 5 is a cross-sectional view of a combustor of a gas turbine in which an alternative flame holding detection system in accordance with the present invention is illustrated. As shown, the upstream and downstream pressure sensors 204, 206 may be positioned in close proximity to the combustor casing fuel injector 160. In this case, the upstream pressure sensor 204 may be positioned in the air flow path 140 between the flow sleeve 124 and the combustion liner 123 just upstream of the combustor casing fuel injector 160, which permits detecting the compressor discharge pressure (PCD) in close proximity to the combustor casing fuel injector 160. The downstream pressure sensor 206 may be positioned just downstream of the combustor casing fuel injector 160. As shown in FIG. 5, the downstream sensor 206 may extend through the endcover 112 such that pressure sensor resides within the interior of the cap assembly 119 (and upstream of the fuel nozzles). By positioning the sensors 204, 206 in close proximity to the combustor casing fuel injector 160, the sensors 204, 206 may be relatively less likely to detect pressure aberrations attributable to causes other than flame holding occurring in the combustor casing 114.

As previously described, it has been discovered that, for many modern gas specific threshold pressure differences prove particularly accurate at predicting flame holding conditions about the combustor casing fuel injector. It will be appreciated that one manner in which this threshold may be expressed is the following equation:

$$dP\,\%_{(meas)} - dP\,\%_{(exp)} \geq T$$

where $dP\,\%_{(meas)}$ is the measured percent decrease in pressure from the upstream sensor 204 to the downstream sensor 206, where $dP\,\%_{(exp)}$ is the expected percent decrease in pressure from the upstream sensor 204 to the downstream sensor 206, and where T is the threshold at which the difference between these two values is sufficiently large that a flame holding condition is sufficiently likely that remedial action is warranted. In addition, it has been determined that threshold T may depend upon the flowpath position at which the downstream sensor 206 is located. Accordingly, when the downstream sensor 206 is positioned similar to that illustrated in FIG. 5 (i.e., within the cap assembly 119), it has been found that, in preferred embodiments, threshold T comprises a value of 0.2%. More preferably, threshold T comprises a value of 0.5%. More preferably, still, threshold T comprises a value of 1%. However, it will be appreciated that the value of T may vary for different combustion modes and combustion systems.

Figure 6:
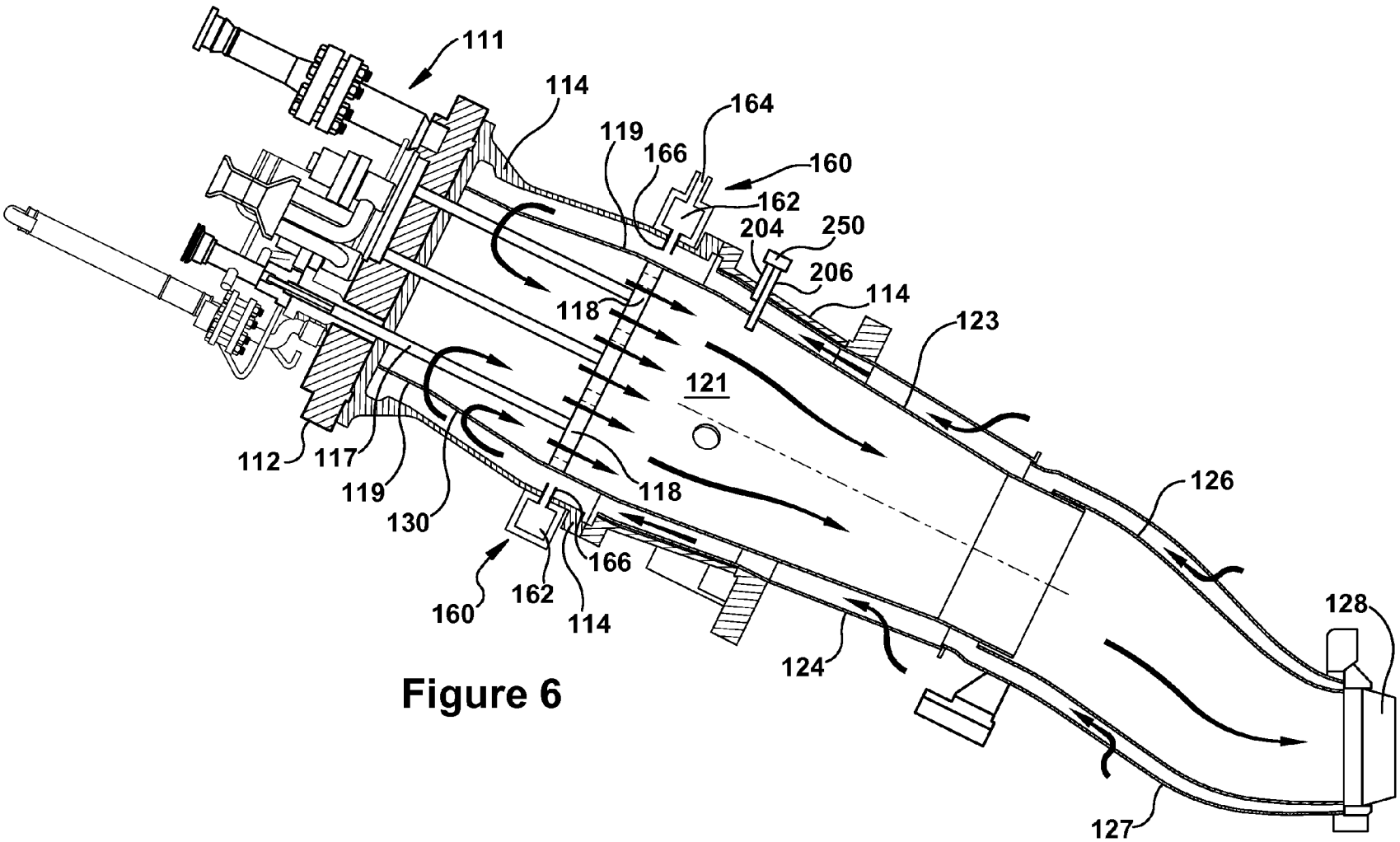
FIG. 6 is a partial cross-sectional view of a combustor of a gas turbine, illustrating an exemplary flame holding detection embodiment in accordance with the present invention.
Figure 7:
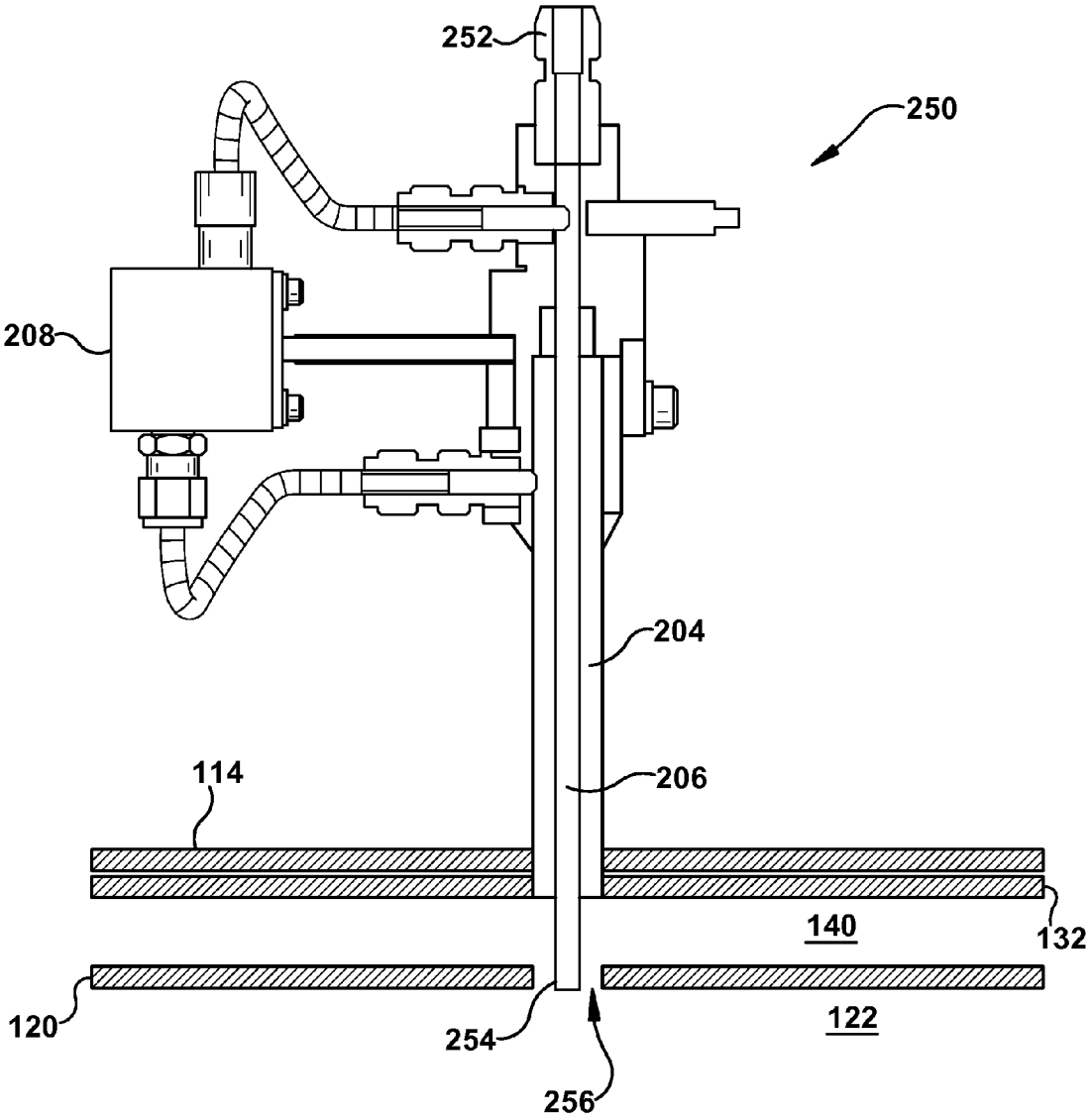
FIG. 7 is partial cross-sectional view of the probe shown in FIG. 6.

As illustrated in FIG. 6, in certain embodiments, the upstream and downstream pressure sensors 204, 206 may be components of an integrated probe 250, which is shown in more detail in FIG. 7. The integrated probe 250 may be operable to detect an increase in a pressure difference across the combustor casing fuel injector 160, such as a difference between the compressor discharge pressure (PCD) and the combustor chamber pressure (PCC). In certain embodiments, for example, the integrated probe 250 may be a differential pressure probe.

The integrated probe 250 may be associated with the combustor 106 as shown in FIGS. 6 and 7. Specifically, the probe 250 may extend through the combustor casing 114, the flow sleeve 124, and the combustion liner 123, and into the combustion chamber 121. The upstream pressure sensor 204 may be positioned on a portion of the probe 250 that becomes positioned in the air flow path into the combustor 106, such as between the flow sleeve 124 and the combustion liner 123 or other such locations. The downstream pressure sensor 206 may be positioned on a portion of the probe 250 that becomes positioned in the combustion chamber 121. Thus, both the compressor discharge pressure (PCD) and the combustor chamber pressure (PCC) may be sensed using a single probe 250. As shown in FIG. 7, the integrated probe 250 may also include the transducer 208. Although the controller 210 is not shown in the illustrated embodiment, the probe 250 may also include the controller 210. Alternatively, the controller 210 may be separate from the probe 250.

In embodiments, the positioning of the downstream pressure sensor 206 within the combustion chamber 121 may be selected to reduce the effect of the temperature within the combustion chamber 121 on the downstream pressure sensor 206. For example, the temperature within the combustion chamber 121 may exceed the temperature that can be tolerated by the downstream pressure sensor 206. Therefore, the downstream pressure sensor 206 may be positioned within the combustion chamber such that a tip 254 of the downstream pressure sensor 206 is near the combustion liner 123. For example, the tip 254 may be about flush with the combustion liner 123 as shown. In some cases, a slight air gap 256 may be formed about the tip 254. The air gap 256 may permit a cooling air flow, which may further reduce the impact of temperature on the downstream pressure sensor 206.

The integrated probe 250 may reduce the cost of retrofitting the gas turbine with the system 200 for detecting flame in the fuel nozzle of the gas turbine, as the integrated probe 250 can detect flame in any one of the fuel nozzles 118 by detecting the pressure drop across the combustor casing fuel injector 160.

In embodiments, the integrated probe 250 may be associated with an existing probe of the gas turbine, such as a combustor dynamics monitoring (CDM) probe. The combustion dynamics monitoring (CDM) probe may be used for measuring parameters of the gas turbine, such as a dynamic pressure of the combustion chamber 121. In such embodiments, the downstream pressure sensor 206 may have a concentric axial bore, which permits transmitting a dynamic pressure signal from the combustion chamber 121 to a pressure dynamic pressure sensor 252 located on the integrated probe 250. In such embodiments, retrofitting a gas turbine with the integrated probe 250 may be as simple as replacing the existing combustion dynamic monitoring (CDM) probe with the integrated probe 250.

As previously described, it has been discovered that, for many modern gas specific threshold pressure differences prove particularly accurate at predicting flame holding conditions about the combustor casing fuel injector. It will be appreciated that one manner in which this threshold may be expressed is the following equation:

$$dP\%_{(meas)} - dP\%_{(exp)} \geq T$$

where $dP\%_{(meas)}$ is the measured percent decrease in pressure from the upstream sensor 204 to the downstream sensor 206, where $dP\%_{(exp)}$ is the expected percent decrease in pressure from the upstream sensor 204 to the downstream sensor 206, and where T is the threshold at which the difference between these two values is sufficiently large that a flame holding condition is sufficiently likely that remedial action is warranted. In addition, it has been determined that threshold T may depend upon the flowpath position at which the downstream sensor 206 is located. Accordingly, when the downstream sensor 206 is positioned similar to that illustrated in FIG. 6 (i.e., within the combustion chamber 121), it has been found that, in preferred embodiments, threshold T comprises a value of 0.2%. More preferably, threshold T comprises a value of 0.5%. More preferably, still, threshold T comprises a value of 1%. However, it will be appreciated that the value of T may vary for different combustion modes and combustion systems.

Figure 8:
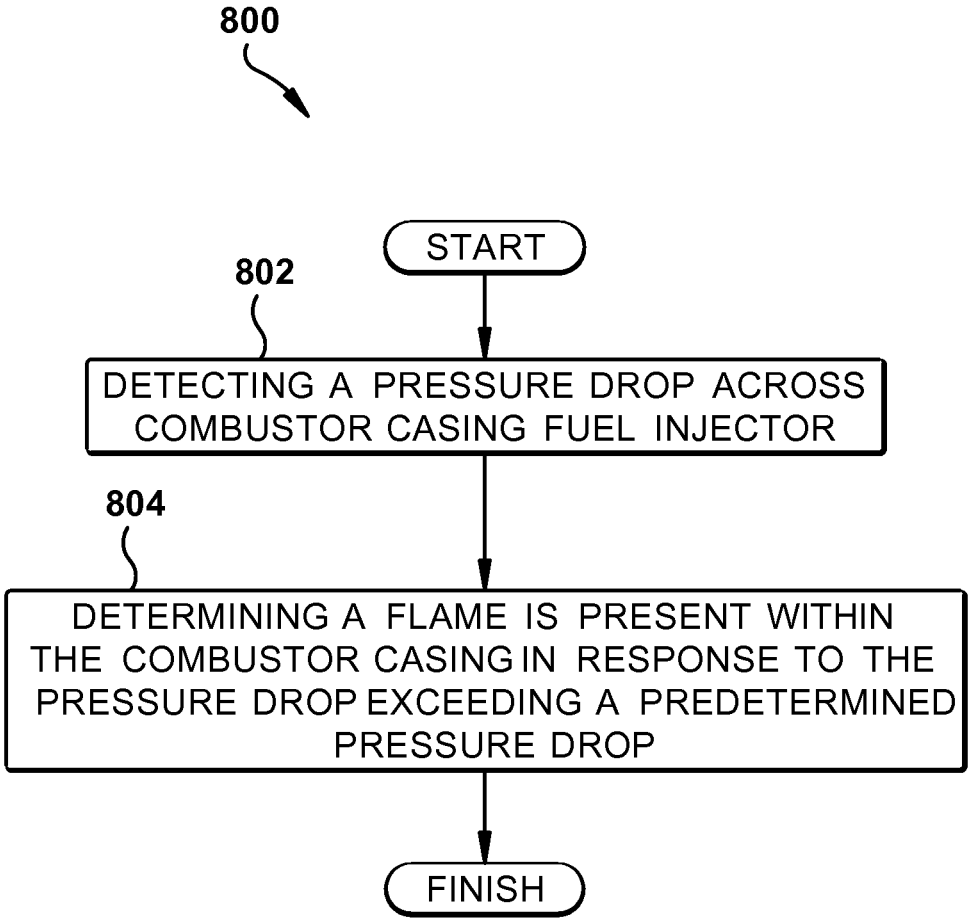
FIG. 8 is a block diagram illustrating an exemplary embodiment of a method for detecting flame holding in the combustor casing in accordance with the present invention.

FIG. 8 is a block diagram illustrating an embodiment of a method 800 for detecting a flame in a combustor casing 114 of a gas turbine engine. In block 802, a pressure drop may be detected across a combustor casing fuel injector 160, which, for example, may be an annular quaternary fuel distributor. For example, the pressure drop may be detected by detecting a pressure difference between the compressor discharge pressure (PCD) and the pressure downstream of the combustor casing fuel injector 160, such as by using one of the systems described above. In block 804, a flame may be determined to present in the combustor casing 114 in response to the pressure drop exceeding an expected pressure drop. For example, the flame may be determined to be present by comparing the detected pressure drop to an expected pressure drop. In some embodiments, the expected pressure drop may be a range of expected pressure drops, in which case the flame may be determined to be present by determining that the detected pressure drop does not fall within the range of expected pressure drops. Thereafter, the method 800 ends. In embodiments, the method 800 may further include extinguishing the flame. The flame may be extinguished in any manner now known or later developed.

Embodiments of the invention are described above with reference to block diagrams and schematic illustrations of methods and systems according to embodiments of the invention. It will be understood that each block of the diagrams and combinations of blocks in the diagrams can be implemented by computer program instructions. These computer program instructions may be loaded onto one or more general purpose computers, special purpose computers, or other programmable data processing apparatus to produce machines, such that the instructions that execute on the computers or other programmable data processing apparatus create means for implementing the functions specified in the block or blocks.

Such computer program instructions may also be stored in a computer-readable memory that can direct a computer or other programmable data processing apparatus to function in a particular manner, such that the instructions stored in the computer-readable memory produce an article of manufacture including instruction means that implement the function specified in the block or blocks.

As one of ordinary skill in the art will appreciate, flame holding is also a concern with the fuel injectors of the fuel nozzles. A related patent application, U.S. Publication No. 2010/0170217, which co-owned by General Electric, the assignee of the present application, is hereby incorporated by reference in its entirety. An embodiment of the present invention further includes having pressure sensors in three locations such that the pressure may be monitored across both the combustor casing fuel injector and the fuel nozzles. For example, the pressure sensors may be located as shown in FIG. 6, with an additional pressure sensor located as "sensor 206" is positioned in FIG. 4. In this manner, if the pressure sensors of FIG. 6 register an increase in pressure over what would be expected (such that a flame holding condition is likely), the pressure sensor that is between the combustor casing fuel injector and the fuel nozzle (i.e., "sensor 206" of FIG. 4) may be used determine where the flame holding is occurring (i.e., if the increase in pressure is due to increased pressure across the combustor casing fuel injector or increased pressure across the fuel nozzles.

As one of ordinary skill in the art will appreciate, the many varying features and configurations described above in relation to the several exemplary embodiments may be further selectively applied to form the other possible embodiments of the present invention. For the sake of brevity and taking into account the abilities of one of ordinary skill in the art, all of the possible iterations is not provided or discussed in detail, though all combinations and possible embodiments embraced by the several claims below or otherwise are intended to be part of the instant application. In addition, from the above description of several exemplary embodiments of the invention, those skilled in the art will perceive improvements, changes and modifications. Such improvements, changes and modifications within the skill of the art are also intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

We claim:

1. In a gas turbine engine that includes a compressor and a combustor, wherein the combustor includes a primary fuel injector within a fuel nozzle and a secondary fuel injector upstream of the fuel nozzle, a system for detecting a flame about the secondary fuel injector, the system comprising:

a first pressure sensor that detects an upstream pressure upstream of the secondary fuel injector;

a second pressure sensor that detects a downstream pressure downstream of the secondary fuel injector;

means for determining a measured pressure difference between the upstream pressure and the downstream pressure; and means for comparing the measured pressure difference to an expected pressure difference;

wherein the combustor comprises a combustion chamber, and the fuel nozzle comprises a position directly upstream of the combustion chamber;

wherein the expected pressure difference comprises a pressure difference that is expected when there is no flame about the secondary fuel injector;

wherein the means for determining the measured pressure difference comprises a transducer operably connected to detect the pressure difference between the upstream pressure and the downstream pressure;

wherein the means for comparing the measured pressure difference to an expected pressure difference comprises a computer-implemented controller;

wherein the computer-implemented controller is configured to determine the expected pressure difference via at least one of a) consulting a stored value; and b) calculating by applying an algorithm to parameters of the gas turbine engine and measured operating conditions; and wherein the computer-implemented controller is configured to indicate that there is a flame about the secondary fuel injector in response the difference between the expected pressure difference and the measured pressure difference exceeding a predetermined threshold.

2. The system of claim 1, wherein the secondary fuel injector comprises a fuel injector that is configured to inject fuel into a flow annulus of the combustor.

3. The system of claim 2, wherein:

the combustor includes a combustor casing, and a cap assembly;

the cap assembly is defined, at least in part, at a forward end by an end cover and at an aft end by the fuel nozzle;

wherein a fuel line extends through the end cover and the interior of the cap assembly to engage the fuel nozzle; and the combustor casing is positioned about the cap assembly such that a combustor casing annulus is formed therebetween.

4. The system of claim 3, wherein the secondary fuel injector comprises a fuel injector that is configured to inject fuel into the combustor casing annulus.

5. The system of claim 4, wherein, at the aft end, the cap assembly engages a liner that surrounds the combustion chamber; wherein, toward the forward end, the cap assembly comprises an inlet that fluidly connects the combustor casing annulus to the interior of the cap assembly; and wherein the secondary fuel injector comprises a fuel injector that is configured to inject fuel into the combustor casing annulus at an axial position that is between: a) the axial position at which the cap assembly engages the liner and b) the axial position of the inlet.

6. The system of claim 4, the first pressure sensor is positioned in the flow annulus of the combustor and upstream of the secondary fuel injector.

7. The system of claim 6, wherein the first pressure sensor comprises a position within the combustor casing annulus.

8. The system of claim 6, wherein the second pressure sensor comprises a position within the combustor casing annulus;

further comprising means for calculating an amount by which the expected pressure difference exceeds the measured pressure difference, and means for determining whether the calculated amount by which the expected difference exceeds the measured pressure difference is greater than a predetermined threshold, wherein the predetermined threshold corresponds to a flame holding condition about the secondary fuel injector.

9. The system of claim 8, wherein the predetermined threshold comprises approximately 0.2%.

10. The system of claim 6, wherein the second pressure sensor comprises a position within the interior of the cap assembly and upstream of the fuel nozzle;

further comprising means for calculating an amount by which the expected pressure difference exceeds the measured pressure difference, and means for determining whether the calculated amount by which the expected difference exceeds the measured pressure difference is greater than a predetermined threshold, wherein the predetermined threshold corresponds to a flame holding condition about the secondary fuel injector.

11. The system of claim 10, wherein the predetermined threshold comprises approximately 0.5%.

12. The system of claim 6, wherein the second pressure sensor comprises a position within the combustion chamber;

further comprising means for calculating an amount by which the expected pressure difference exceeds the measured pressure difference, and means for determining whether the calculated amount by which the expected difference exceeds the measured pressure difference is greater than a predetermined threshold, wherein the predetermined threshold corresponds to a flame holding condition about the secondary fuel injector.

13. The system of claim 12, wherein the predetermined threshold comprises approximately 0.5%.

14. The system of claim 1, further comprising an integrated probe, the integrated probe extending through an air flow path of the combustor into the combustion chamber;

wherein:

the first pressure sensor is located on a portion of the integrated probe that is positioned in the air flow path; and the second pressure sensor is located on a portion of the integrated probe that is positioned in the combustion chamber.

15. In a gas turbine engine that includes a compressor and a combustor, wherein the combustor includes a primary fuel injector within a fuel nozzle and a secondary fuel injector that is upstream of the fuel nozzle and configured to inject fuel into a flow annulus of the combustor, wherein the combustor comprises a combustion chamber, and the fuel nozzle comprises a position directly upstream of the combustion chamber, a method for detecting a flame holding condition about a fuel injector, the method including the steps of:

detecting an upstream pressure upstream of the secondary fuel injector;

detecting a downstream pressure downstream of the secondary fuel injector;

determining a measured pressure difference between the upstream pressure and the downstream pressure;

comparing the measured pressure difference to an expected pressure difference;

determining the expected pressure difference via at least one of a) consulting a stored value; and b) calculating by applying an algorithm to parameters of the gas turbine engine and measured operating conditions; and indicating that there is a flame about the secondary fuel injector in response the difference between the expected pressure difference and the measured pressure difference exceeding a predetermined threshold.

16. The method of claim 15, wherein:

the combustor includes a combustor casing and a cap assembly;

the cap assembly is defined, at least in part, at a forward end by an end cover and at an aft end by the fuel nozzle;

wherein a fuel line extends through the end cover and the interior of the cap assembly to engage the fuel nozzle;

the combustor casing is positioned about the cap assembly such that a combustor casing annulus is formed therebetween; and the secondary fuel injector comprises a fuel injector that is configured to inject fuel into the combustor casing annulus.

17. The method of claim 15, further comprising the steps of:

calculating an amount by which the expected pressure difference exceeds the measured pressure difference;

determining whether the calculated amount by which the expected difference exceeds the measured pressure difference is greater than a predetermined threshold; and wherein the predetermined threshold corresponds to a flame holding condition about the secondary fuel injector.

18. The method of claim 15, wherein the downstream pressure comprises a first downstream pressure, and the detecting the first downstream pressure downstream of the secondary fuel injector comprises detecting a pressure at a position that is upstream of the fuel nozzle;

further comprising the steps of:

detecting a second downstream pressure downstream of the primary fuel injector;

determining a measured pressure difference between the first downstream pressure and the second downstream pressure;

comparing the measured pressure difference between the first downstream pressure and the second downstream pressure to an expected pressure difference;

determining if a flame holding condition is about the primary fuel injector or the secondary fuel injector based upon the comparisons between the measured pressures and expected pressures between a) the first downstream pressure and the second downstream pressure and b) the first downstream pressure and the second downstream pressure.

* * * * *